United States Patent [19]

Schwanke, Jr.

[11] Patent Number: 4,901,706

[45] Date of Patent: Feb. 20, 1990

[54] ASH MAT

[76] Inventor: Leroy F. Schwanke, Jr., 95 Great Ring Rd., Sandy Hook, Conn. 06482

[21] Appl. No.: 859,301

[22] Filed: May 5, 1986

[51] Int. Cl.[4] ..... F23J 1/00

[52] U.S. Cl. ..... 126/500; 126/221; 126/242; 126/554; 126/25 R

[58] Field of Search ..... 126/242, 221, 283, 245, 126/243–244, 144, 500, 55 P, 25 R, 25 B, 25 C; 110/165 R, 165 A, 166

[56] References Cited

U.S. PATENT DOCUMENTS

| | | | |
|---|---|---|---|
| 852,116 | 4/1907 | Herrick | 126/221 |
| 1,132,561 | 3/1915 | Colwell | 126/242 |
| 1,193,399 | 8/1916 | Ladd | 126/221 |
| 1,266,412 | 5/1918 | Crane | 126/221 |
| 3,424,145 | 1/1969 | Stitt | 126/25 R |
| 3,495,762 | 2/1970 | Verbic | 126/242 X |
| 4,332,828 | 6/1982 | Gallagher | 126/221 X |

FOREIGN PATENT DOCUMENTS

| | | | |
|---|---|---|---|
| 794132 | 2/1936 | France | 126/221 |
| 1112236 | 10/1954 | France . | |

*Primary Examiner*—Larry Jones

*Attorney, Agent, or Firm*—Richard A. Craig

[57] ABSTRACT

An ash mat comprises a laminate preformed to the size and shape of the bottom of a structure in which ashes are generated, such as a fireplace, a wood burning stove or an outdoor bar-b-que appliance. The laminate is made up of two outer layers of aluminum foil and an inner layer of fiberglass matting or spun glass matting adhered to the outer layers. The laminate is provided with handles so that it can be picked up easily, thus facilitating disposal of the mat and its contents. The handles are in the form of holes through the laminate and are preferably reinforced to prevent tearing of the material and to avoid sharp edges which would be hazardous to the user.

8 Claims, 1 Drawing Sheet

ASH MAT

BACKGROUND OF THE INVENTION

The present invention relates to ash mats and more particularly to a disposable ash mat of laminated construction preformed to the size and shape of the bottom of a structure in which ashes are generated, such as a fireplace, a wood burning stove or an outdoor bar-b-que appliance, in each case for catching ash residue and facilitating disposal thereof, and in the case of a bar-b-que appliance also for catching cooking residue and for aiding in preventing deterioration of such appliance.

In addition to being pre-shaped to the size and shape of the bottom of the structure in which it is to be used, the inventive ash mat is provided with handles whereby the ash-laden mat can easily be picked up, the handles simplifying the handling of the ash mat when it is desired to dispose of same.

Williams U.S. Pat. No. 3,994,275, issued Nov. 30, 1976 discloses a free-standing fireplace reflector comprising a laminate of aluminum sheeting and a substrate of fire-retardant material. This prior art device catches ashes but is box-shaped and has no handles. A bottom member is disclosed for catching ashes but there are no handles.

Other less pertinent prior art U.S. Patents which were found in a search are:

| U.S. Pat. No. | Date | Inventor |
|---|---|---|
| 1,423,352 | July 18, 1922 | Milholen |
| 2,162,579 | June 13, 1939 | Hogan |
| 2,377,665 | June 5, 1945 | Best |
| 3,495,762 | February 17, 1970 | Verbic |
| 4,508,096 | April 2, 1985 | Slattery |

It is an important object of the invention to provide a disposable ash mat which is of simplified construction and is readily handled when laden with ashes.

It is a further object to provide an ash mat which is shaped to conform to the bottom of a structure in which ashes are generated.

It is a additional object to provide an inexpensive ash mat.

Other objects and advantages will appear hereinafter.

SUMMARY OF THE INVENTION

An ash mat embodying the invention comprises a laminate at least generally preformed to the size and shape of the bottom of a structure in which ashes are generated, such as a fireplace, a wood burning stove or an outdoor bar-b-que appliance. The laminate is made up of two outer layers of aluminum foil and an inner layer of fiberglass matting or spun glass matting adhered to the outer layers. The laminate, which can easily be form-fitted to the bottom of the structure, is provided with handles so that it can be picked up easily, thus facilitating disposal of the mat and its contents.

The handles are in the form of holes through the laminate and are preferably reinforced to prevent tearing of the material and to avoid having sharp edges which would be hazardous to the user.

DESCRIPTION OF THE INVENTION

Figure 1:
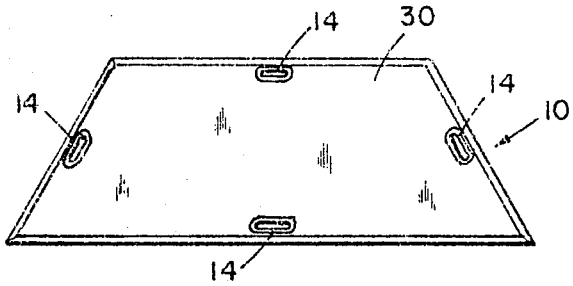
FIG. 1 is a plan view of a preferred form of ash mat, preformed for use in a fireplace.

FIG. 1 shows an ash mat 10 which is preformed to conform generally to the size and shape of the bottom of a fireplace. Thus, mat 10 is generally trapezoidal.

Mat 10 is provided with spaced handles 14 near its outer periphery to facilitate the handling of mat 10 when it is laden with ashes. Handles 14 are in the form of holes through mat 10.

Figure 2:
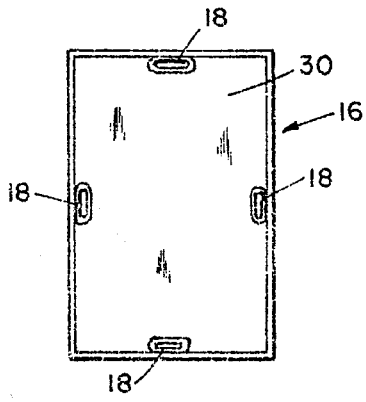
FIG. 2 is a view similar to FIG. 1, but showing an ash mat preformed for use in a wood stove.

FIG. 2 shows an ash mat 16 preformed to generally rectangular shape to conform generally to the bottom of a wood stove. Like mat 10, mat 16 is provided with spaced handles 18 near its outer periphery to facilitate handling when mat 16 is laden with ashes. Handles 18 are in the form of holes through mat 16.

Figure 3:
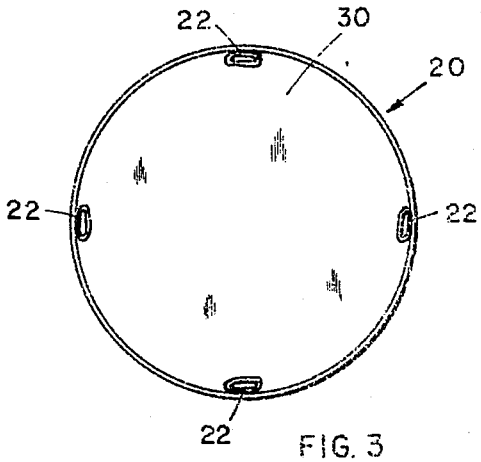
FIG. 3 is a view similar to FIG. 1, but showing an ash mat preformed for use in an outdoor bar-b-que.

FIG. 3 shows an ash mat 20 preformed to generally round shape to conform generally to the bottom of an outdoor bar-b-que appliance. Like mat 10, mat 20 is provided with spaced handles 22 near its outer periphery to facilitate handling when mat 20 is laden with ashes and other cooking debris.

Figure 4:
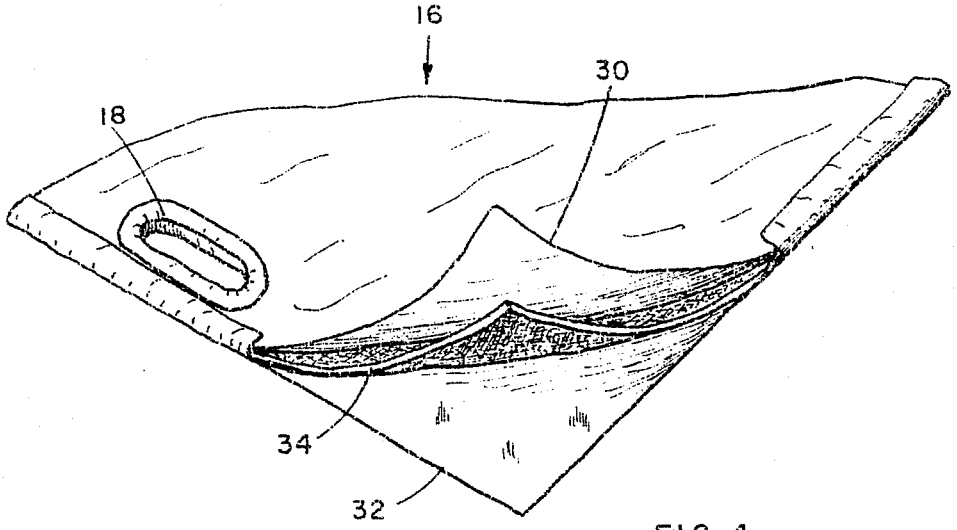
FIG. 4 is a view showing the mat of FIG. 2 fragmentarily de-laminated to show the various layers.

Mats 10, 16 and 20 are laminated, each having three layers of material. As revealed in FIG. 4, which shows mat 16 fragmentarily de-laminated, and which is equally applicable to mats 10 and 20, mat 16 is a laminated structure of three layers, namely, outer layers 30 and 32 of aluminum foil and a central layer 34 of fiberglass matting or open glass matting, layers 30, 32 and 34 being secured together by any suitable means such as cementing and/or stitching.

Other materials of which layers 30 and 32 can be made are steel, brass, copper or other suitable non-flammable, non-meltable, metal foil of such thickness and flexibility to permit folding for packaging, convenient forming to the fireplace base and puncture resistance to permit removal and disposal of ashes.

Layer 34 must be of fireproof material. Other examples of suitable materials for layer 34 are flexible multi-stranded, non-flammable, non-meltable wire such as steel, copper or brass; high temperature resistant, fire resistant organic fibers such as Nomex® or inorganic fibers such as long fiber asbestos or mica.

The handles, i.e., holes 14, 18 and 22 are preferably reinforced, as by additional aluminum foil, to prevent the material of mats 10, 16 and 20 from tearing when mats 10, 16 and 20 are handled. Furthermore, the reinforcing material should extend through holes 14, 18 and 22, since the material of layer 34 may be toxic to human skin. Additionally, and for the same reason, layer 34 should be covered with non-toxic material around the outer peripheries of mats 10, 16 and 20. The reinforcing material can be provided by making either layer 30 or layer 32 larger than the other and folding the excess material over the other layer and crimping same in place.

It is apparent that the invention effectively attains the stated objects and advantages and others.

The disclosed details are exemplary only and are not to be taken as limitations on the invention except as those details are included in the appended claims.

What is claimed is:

1. A disposable ash mat having an outer periphery preformed generally to conform to the bottom of a structure in which ashes are generated, said mat comprising a foldable laminate including outer layers of metal foil and an inner layer of fireproof material adhered to both of said outer layers, and said mat having handles within said outer periphery to facilitate disposal of the mat and its contents.

2. A mat according to claim 1 wherein said handles are provided by holes through said layers of said laminate.

3. A mat according to claim 2 wherein said holes are reinforced.

4. A mat according to claim 3 wherein said inner layer is isolated from touch by a user.

5. A mat according to claim 1 wherein said metal is aluminum and said fireproof material is fiberglass matting or open glass matting.

6. A mat according to claim 1 wherein said periphery is trapezoidal to conform to the bottom of a fireplace.

7. A mat according to claim 1 wherein said periphery is rectangular to conform to the bottom of a wood stove.

8. A mat according to claim 1 wherein said periphery is round to conform to the bottom of an outdoor bar-b-que appliance.

* * * * *